United States Patent [19]

Erlandson

[11] Patent Number: 4,936,299

[45] Date of Patent: Jun. 26, 1990

[54] METHOD AND APPARATUS FOR REHABILITATION OF DISABLED PATIENTS

[75] Inventor: Robert F. Erlandson, Birmingham, Mich.

[73] Assignee: Metropolitan Center for High Technology, Detroit, Mich.

[21] Appl. No.: 245,406

[22] Filed: Sep. 16, 1988

[51] Int. Cl.[5] ..... A63B 22/00

[52] U.S. Cl. ..... 128/25 R

[58] Field of Search ..... 128/25 R, 25 B, 26, 128/782, 363, 364; 272/130, DIG. 6, 76; 901/3, 6, 4, 35, 33, 46; 434/258, 260; 273/1 GE; 414/9

[56] References Cited

U.S. PATENT DOCUMENTS 4,766,844 8/1988 Brewer et al. ..... 901/6 X

FOREIGN PATENT DOCUMENTS 2725662 12/1978 Fed. Rep. of Germany ..... 272/76

OTHER PUBLICATIONS

NBS/RIA Report; "Notes Edited from NBS/RIA Robotics Research Workshop"; 1981.

*Primary Examiner*—Richard J. Apley
*Assistant Examiner*—H. Flaxman
*Attorney, Agent, or Firm*—Gifford, Groh, Sprinkle, Patmore and Anderson

[57] ABSTRACT

A rehabilitation apparatus having a robotic arm controlled by application software and a control board of a CPU. The patient is required to contact a home switch positioned adjacent to the patient and upon command contact a switch on an end defector which has been positioned in a predetermined position by a robotic arm. The patient's ability to move the various positions is monitored and stored in the CPU. The method for use of the apparatus is also disclosed.

12 Claims, 3 Drawing Sheets

METHOD AND APPARATUS FOR REHABILITATION OF DISABLED PATIENTS

BACKGROUND OF THE INVENTION

I. Field of the Invention

This invention relates to an apparatus and method for use of the apparatus in the rehabilitation of disabled patients. More particularly this invention relates to a method and apparatus for rehabilitation having a robotic arm controlled by a central processing unit (CPU).

II. Description of the Prior Art

Hundreds of thousands of people each year are disabled as a result of strokes, traumatic brain injury and other conditions. These patients suffer movement disorders including: decreased speed of movement and depressed bilateral coordination; decreased ranges of motion and muscular weakness; rigidity of movement (stiffness) and ataxia (unsteady movement); abnormal response lags during measured movement; and excessive fatigue.

It is known that patients may be rehabilitated through physical therapy. Frequently, a physical therapist will lead a patient throuqh a series of patterns or exercise routines such as the Brunnstrom diaqonal therapeutic patterns in order to evaluate the patient's disability and to provide therapy for the condition. However, such exercises require considerable time to perform. Additionally, there is a shortage of therapists available to perform the therapy. Finally, it is not possible to develop quantitative standards for determining extent of the patient's disability, as well as the progress of the patient during the therapy.

It is also known to use robotic arms in the medical field for care and assistance of patients. Robotic arms may be used as functional aids for the handicap to assist the patients in the performance of routine activities. As is disclosed by Leifer et al in "Development and Evaluation of an Advanced Manipulation Aid for the Severely Disabled", *Rehabilitation Research and Development Center* 1986 Report, it is known to use a mobile unit having a robot as a home aid for replacing lost motor skills needed in day-to-day living such as food preparation and food service. It is also known, as disclosed in Seamone and Schmeisser, "Early Clinical Evaluation of Robotic Arms/Worktable System for Spinal-Cord-Injured Persons", *Journal of Rehabilitation Research and Development*, January 1985, page 38, 3rd, to provide a work station to allow subject to complete certain vocational tasks such as, using a typewriter, using a telephone, and reading a book. However, none of the above devices are suitable for rehabilitation of disabled patients.

SUMMARY OF THE INVENTION

Disclosed is a method of rehabilitation of disabled patients and apparatus for use in performing the method. The apparatus consists of at least one patient station which is controlled by a central processing unit. Each patient station is provided with a first response device which is provided with a light and a switch. The response device is selectively moved to predetermined positions by a robotic arm which is controlled by the CPU. A second response device or home switch may also be provided. After the light on a response device is illuminated in response to a signal from the CPU, the patient is directed to touch the switch of the response device to produce a signal which is received and stored by the CPU.

A method of use of the rehabilitation apparatus follows the steps of generating a signal to solicit a response of the device on command from a CPU to the home switch or end effector, soliciting a response from the patient at the responsive device, waiting a period of time to receive the response, recording the time of the response in the event the response is made within the waiting period, recording a non-occurance in the event that no response is made by the patient within the waiting period in the CPU. Additionally, the method may utilize a predetermined exercise routine in which the end effector is moved through a pattern of predetermined positions for receiving responses from the patient at each position. Additionally, the method involves evaluating the responses made by the patient to the solicitations provided by the apparatus. Finally, a method may utilize the step of compiling reports of the patient's responses from the data stored by the CPU. Data collected by the CPU will enable the therapist to compile reports on such variables as; patient reaction time, hits, misses, bilateral movement, and range capability. The reports may be shown in as much detail as required by the therapist.

It can be seen that the method and apparatus provide accurate repeatable standards for comparison and evaluation of the rehabilitation therapy. Additionally, once the therapist initiates a routine, the patient is automatically led through the routine, thus freeing the therapist to begin other routines with additional patients at additional patient stations. A number of robotic arms may be connected to the same CPU, so that a single therapist may activate the apparatus to treat as many as four patients at the same time. These and other advantages of the invention may be seen in the attached drawings and following detailed description of the preferred embodiment.

DESCRIPTION OF THE PREFERRED EMBODIMENTS

A rehabilitation apparatus invention will now be explained with reference to the figures of the drawings. The rehabilitation device is suitable for use with a wide range of disabled patients, including those suffering stroke, brain damage, burns, arthritis or most conditions related to the loss of motor skills.

Figure 1:
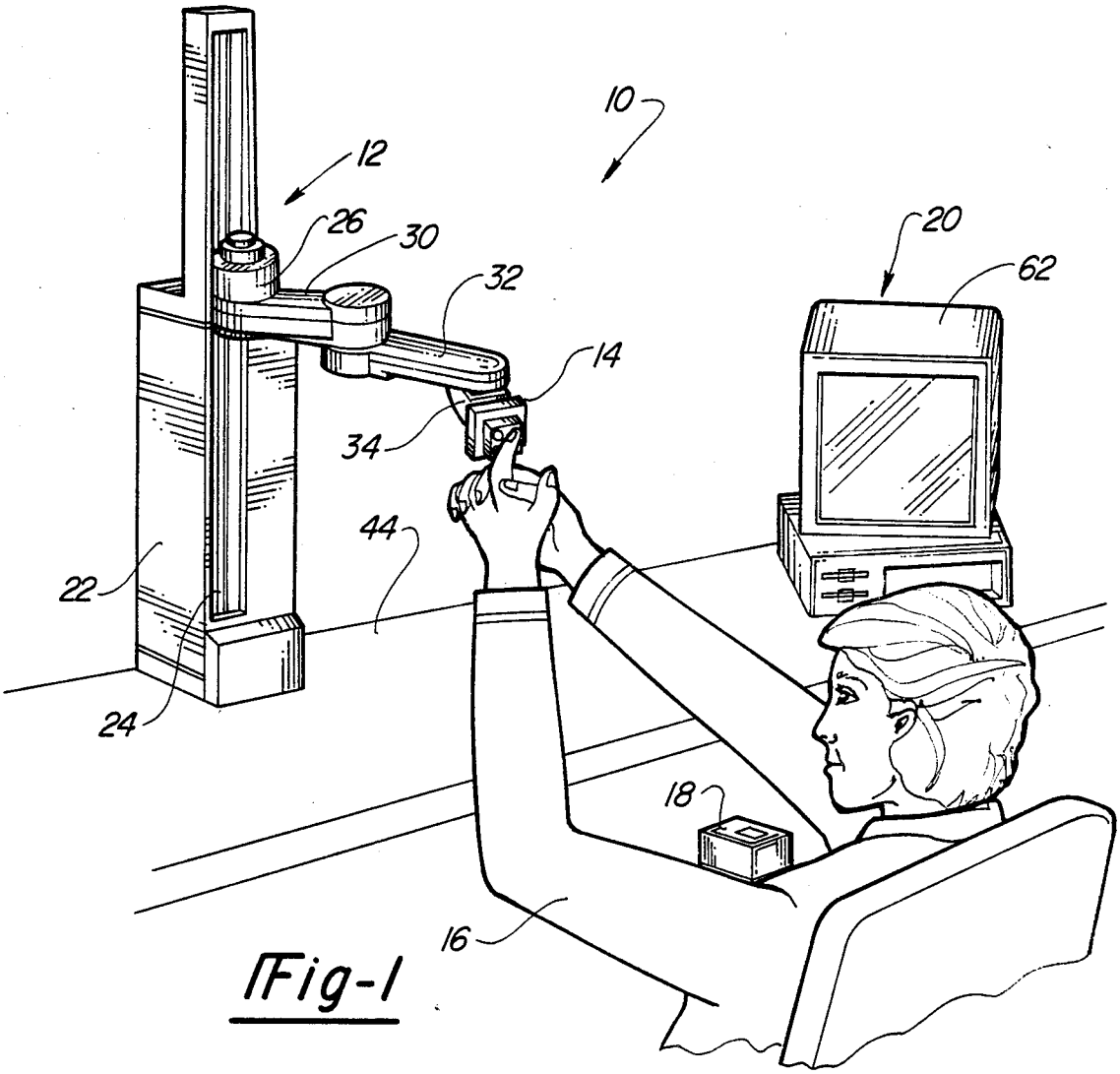
FIG. 1 shows a perspective view of a patient using the apparatus in accordance with the method of the invention.
Figure 4:
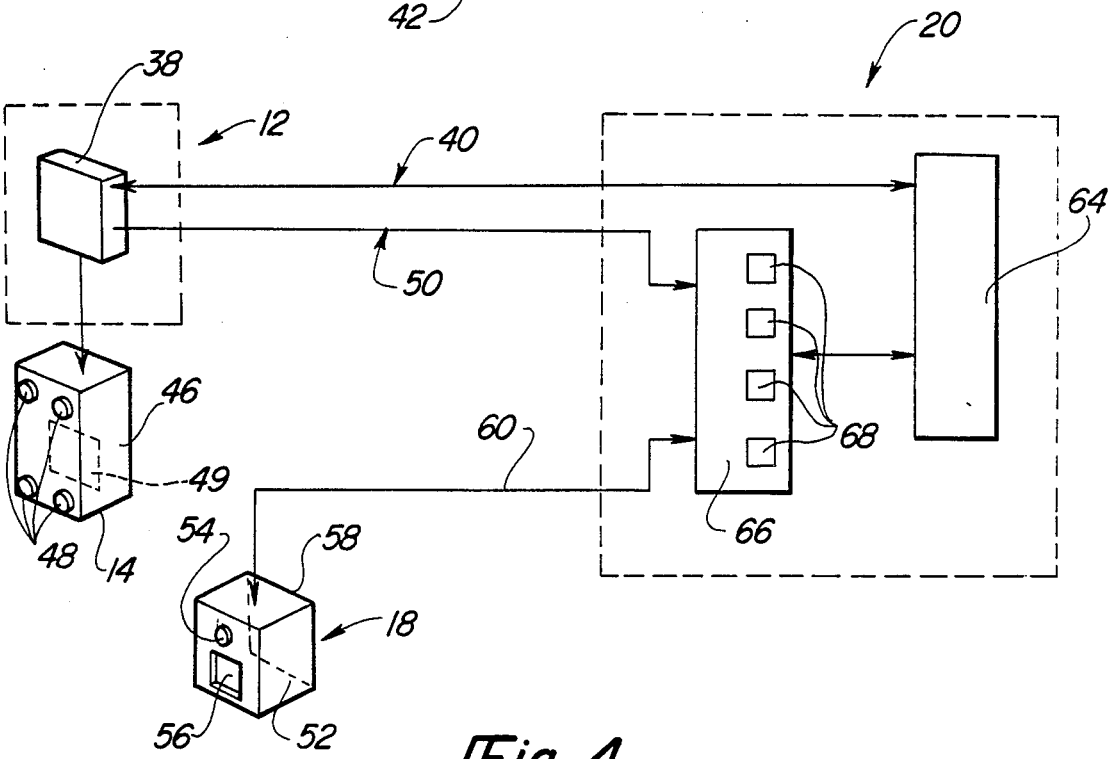
FIG. 4 is a schematic view of the apparatus according to the invention.

The rehabilitation apparatus is best shown in FIG. 1, wherein a patient station having a robotic arm 12 with a first response device or end effector 14 is positioned near a patient 16. A second response device or home switch 18 is positioned adjacent the patient. The home switch 18 and end effector 14 as well as the robotic arm 12 connected to a central processing unit (CPU)20 as shown in FIG. 4.

The robotic arm 12 may be of any suitable type having a proper range of motion, size, and speed appropriate for the application. The robotic arm must have the capability of moving the end effector 14 to selected predetermined locations relative to the patient. Additionally, the robotic arm should have the ability to properly align the end effector to a predetermined alignment with respect to the patient. Additionally, the robotic arm should have a relatively uncluttered appearance so as not to appear threatening to the patient. Finally, a robotic arm should have the ability to move at a slow speed from one position to another for tap along exercises as will be described more fully below. A suitable robotic arm for this purpose is known as the RMX personal robotic arm distributed by UMI, Inc. of Detroit, Mich.

Figure 2:
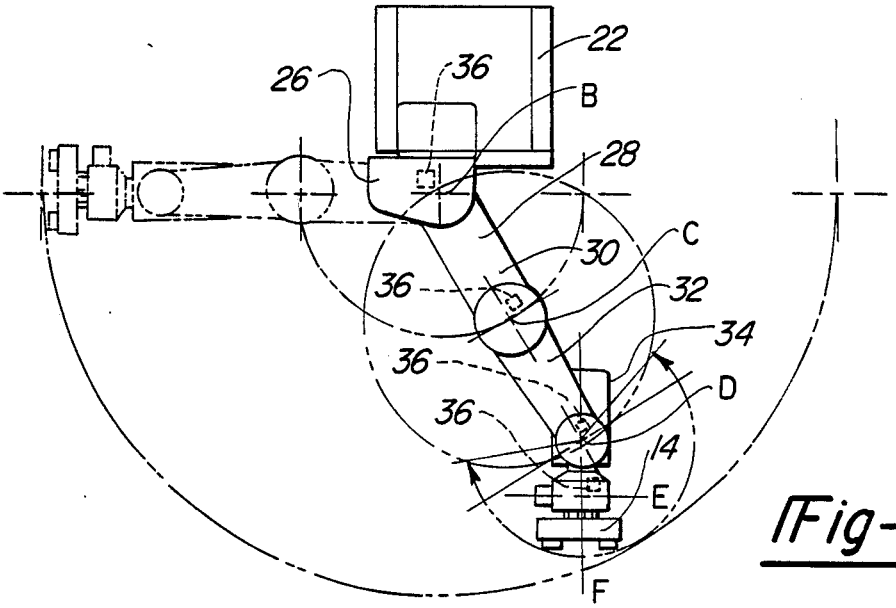
FIG. 2 is a schematic top view of a robotic arm showing the range of movement according to the invention.
Figure 3:
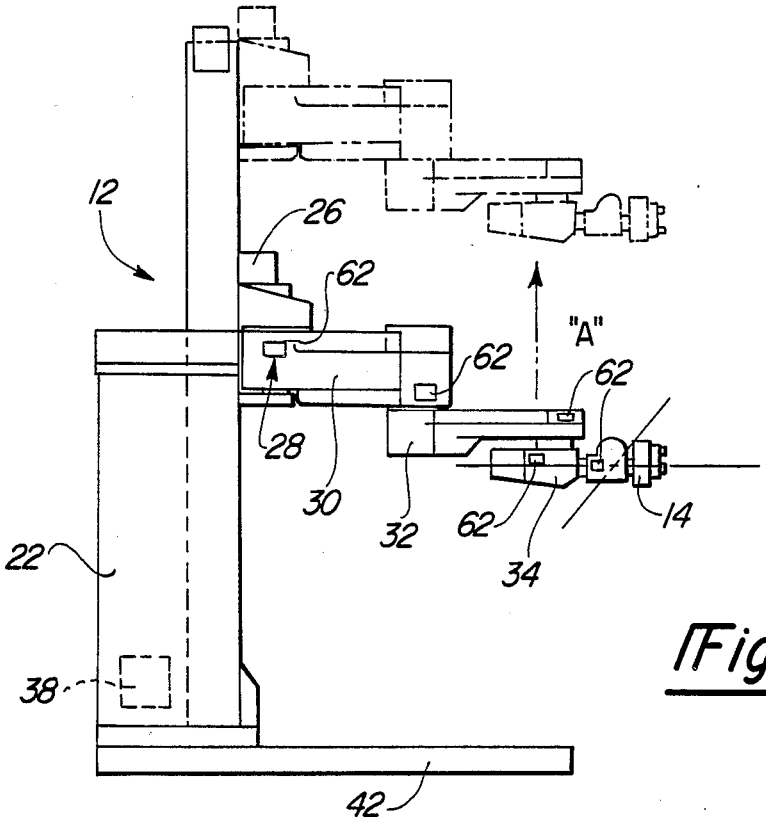
FIG. 3 is a side view of the robotic arm according to the invention.

In the preferred embodiment, the robotic arm has a longitudinal base 22 having a track 24 supporting a shoulder bracket 26 for reciprocal movement along a vertical axis in the direction of Arrow A, shown in FIG. 3. The shoulder bracket 26 of the robotic arm has a vertical travel along the track of approximately 36 inches. One end 28 of a shoulder 30 is pivotally mounted to the bracket 26 to rotate about Axis "B" shown in FIG. 2. An elbow 32 is pivotally attached at an opposite end of the shoulder to rotate about Axis "C". The elbow 32 has a wrist 34 pivotally attached at a distal end of the elbow to rotate about. The wrist supports the end effector 14 for yaw, pitch (axis E) and roll (axis F). The end effector thus is movable to provide a desired alignment of the end effector with respect to patient.

The robotic arm 12 is provided with servo motors (not shown) to rotate the shoulder, elbow, wrist and end effector of the robotic arm about the respective axes, in response to commands from an internal control device 38. The internal control device 38 is connected to the CPU 20 by a wire 40 and controls the operation of the various servo motors to position the end effector 14 in a predetermined location in accordance to commands received by the internal control device 38 from the CPU.

As is known in the art, sensors 36 are positioned to provide signals for determining the position of the end effector.

In the preferred embodiment, the robotic arm 12 is compact and has a platform 42 for supporting the robotic arm on a table 44. However, the robotic arm could be of other suitable types such as wall mounted. The end effector 14 is a response device to solicit and receive responses from the patient. In the preferred embodiment, the end effector 14 has a base 46 for supporting four lighted switches 48 as shown in FIG. 4. The switches may be of any suitable type operable upon contact to produce a signal such as an illuminated pushbutton switch. Each switch may be illuminated in a different color. Each of the light switches is illuminated in response to signals from a remote process unit CPU 49 housed with the base 46. The remote CPU 49 has a random access memory and controls the illumination of the lights 48 as well as receives the signals generated by the switches when contacted or triggered. The remote process unit CPU 49 is connected to the CPU 20 by a wire 50 through the robotic arm to the CPU 20. As will be set forth in detail below, one or more of the lighted switches will be illuminated in response to a command from the CPU to the remote processing unit after the end effector has been positioned in a desired location. The patient has been previously directed to contact the switch after the light has been illuminated. If the patient is successful, a signal is generated by the switch which is then received by the remote processing unit and communicated to the CPU 20. Alternatively, the signals may be conducted from the switches and lights directly to the control board without a remote processing unit.

The home switch 18, best shown in FIG. 4, is a response device like the end effector. The home switch 18 has a housing 52 for mounting an indicator light 54 and a contact switch 56. The housing is provided with a flat surface 58 so that the home switch may be positioned at a desired location within the patient's reach as shown in FIG. 1. The housing 52 may be of any suitable material such as metal or plastic. The indicator light 54 may be of any suitable type and may be red. The light 54 is activated upon a signal from the CPU. The contact switch 56 is of any suitable type such as a push button or membrane switch which provides an analog signal when the switch is contacted. The switch and light are connected by a wire 60 to the CPU.

Figure 5:
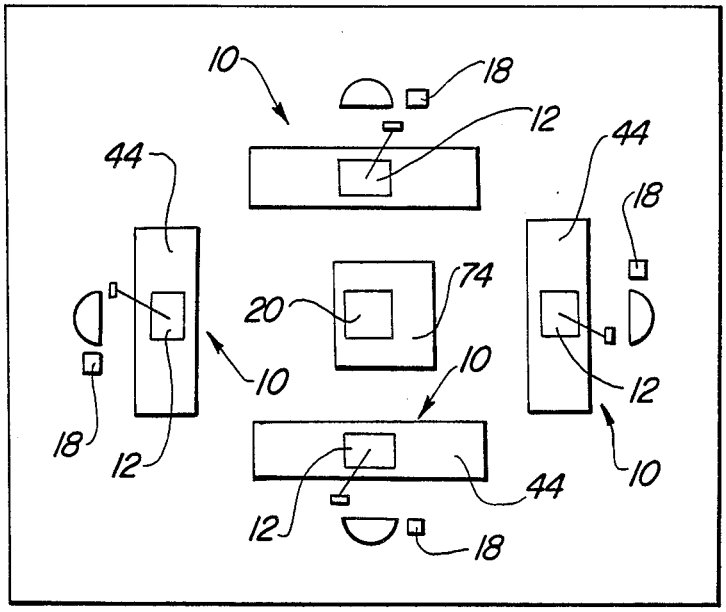
FIG. 5 is a schematic view showing multiple robotic arms in position for use in accordance with the invention.

As shown in FIG. 5, multiple patient stations 10 may be integrated with a single CPU 20. The CPU is located centrally on a table 78 so that the therapist may observe the patient stations. Each patient station is provided with a robotic arm 12 and home switch 18 which are integrated with the CPU 20.

The CPU 20 may be of any suitable type such as a personal computer. The CPU is equipped with a screen 62 and keyboard (not shown) for the entry of data. As shown in FIG. 4, the CPU is adapted to load and store applications software 64 which may be provided by a suitable means such as floppy disks. The CPU is also provided with a control board 66 having a plurality of PROMS 68. Each of the PROMS 68 is programmed to store logic for particular exercise routines. In the preferred embodiment, logic is stored on PROMS because of the limited memory of the personal computer. The application software communicates with the PROMS to direct the response devices and robotic arm through the desired exercise routine. Additionally, the therapist selects an activity from the software. If the therapist selects an activity in the form of an exercise routine, the software selects and enables a PROM having the appropriate routine. The PROM then acts to illuminate an appropriate light such as the light 54 of the home switch. When the patient is successful in responding to the light signal and triggering the appropriate switch, the switch then sends a signal. The signals are received from the end effector and home switch response devices. If the end effector has been provided with the remote processing unit 49, the CPU 20 may be provided with data relating to the responses of the patient. The signals and/or data are then received and stored by a designated PROM and software.

In addition to interacting with the plurality of PROMS on the control board 66, the application software is connected to the internal control 38 of the robotic arm. As is known in the art, the application software provides coordinates for a specific location where the end effector of the robotic arm is to be positioned. On command from the software, the internal control directs a robotic arm to position the end effector at the desired coordinates. Once the end effector has been properly positioned as determined by the sensors, the internal control sends a signal to the software to indicate that the robotic arm and end effector are properly positioned. As will be apparent from the operation described below, other embodiments of the invention are contemplated within the scope of the invention. The end effector may be similar to the home switch having a single indicator light and single pushbutton. Alternatively, the home switch may be provided with a switch having internal lighting. Additionally, switches which require exact positioning of movable elements may be provided to provide therapy on mobility and flexibility.

OPERATION

According to the method of use of the apparatus, many types of exercise routines may be provided to the patient. However, the basic method has the steps of positioning a response device at a predetermined position, soliciting a response from the patient, waiting a period of time for the response, receiving and storing a signal indicating a proper response, recording the non-occurrence of a response signal in the event that a signal is not produced, and analyzing the performance of the patient. An exercise routine is performed by repeating the sequence of steps. Two different response devices may be utilized and a robotic arm controlled by the CPU moves one response device through a predetermined pattern of response positions. Many different types of exercise routines may be automatically performed by the patient in response to the apparatus.

Figure 6:
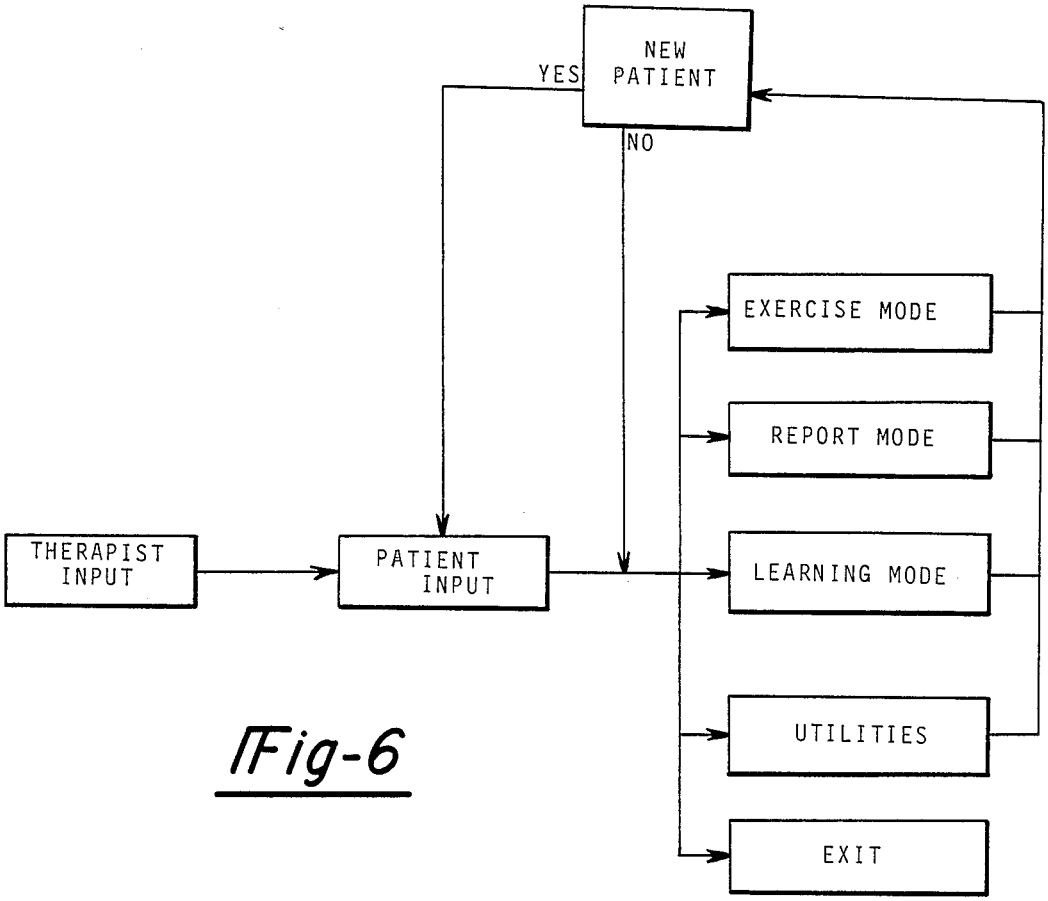
FIG. 6 is a flow chart of the method according to the invention.

As set forth in FIG. 6, in the preferred embodiment of the invention, the therapist first enters patient data such as name and address, physical condition, age, etc. to a file in response to a prompt from the application software. The therapist is then prompted to select one of the following modes: exercise, report, utilities, learning or exit. If the therapist selects the exercise mode the screen provides a directory of different exercises. The therapist selects a particular exercise routine through the keyboard. The application software then initializes a particular PROM having the desired exercise routine. While the exercise routines vary in nature and purpose, the basic method includes energizing the indicator light on the home switch tapping the home switch to generate a first signal receiving and storing the first signal in the control board of the CPU, directing the end effector to a predetermined position, energizing a light on the end effector, contacting the end effector switch in response to the light signal, receiving and storing a second signal in the control board of the CPU; measuring the time difference between the first signal and the second signal in the control board identifying and filing the time difference in the patient file. The exercise routine may be completed by energizing the light of the home switch and having the patient move to contact the home switch and again sending a signal to be stored and filed in response to the contact of the home switch.

The exercise patterns may be of a "wait" type in which the light on the home effector is energized and the robotic arm stays in position until the switch of the end effector is contacted before moving to a another position. The routine may be varied by having the arm waiting a specific period of time for a contact and then moving to another position whether or not it receives contact from the patient. Exercise patterns utilizing "following" exercises may be selected in which the patient follows the arm from position to position tapping the end effector at each position. The patient could also be required to hit the home switch in between each contact of the end effector switch.

Additionally, memory exercises may be performed by use of the various colored lights on the end effector. The patient is required to contact the colored light switches in a particular sequence. The lights are illuminated in a particular pattern and the patient is subsequently required to hit the switches in the same pattern. In this way the patient's ability to remember a sequence, the patient reaction time, and/or the tapping time may be calculated. Additionally, the patient may be required to move from home to a moving target, from home to a stationary target, to tap a moving target, and be required to tap by memory.

The patient may be subjected to exercise pattern such as a Brunnstrom diagonal movement. These movements are well known in the art and given by therapist to determine the range and degree of mobility of the patient. The patient may be required to move a single arm or to use a unimpaired arm to assist in moving the impaired arm to a particular position.

Data from each of the various different types of routines in the form of the response time, the number of successful hits, number of misses, etc. is covered by the PROM and stored in the patient's file. When an exercise is complete the therapist may continue with another exercise or develop a particular exercise for the specific patient. In the learning mode, the therapist defines a set of particular points for the robotic arm and the robotic arm is manually positioned at each of the predetermined positions. When the robotic arm and end effector are properly aligned in the desired position, the CPU is directed to note the coordinates of the end effector and store the coordinates as an exercise point. Once the therapist has manually manipulated the robotic arm through the desired positions for the routine and stored the positions in the computer, the patient may then be lead through a routine designed for the specific patient. This routine is then stored in the patient's file and available for recall when desired.

After completing the exercises the therapist may select the report mode in which the therapist may select any of a variety of parameters to develop a report on the patient's performance. The software assembles the data to determine range of motion of the patient, the speed at which the patient may perform the exercises and may compare the patient's performance to previous performances. A utilities mode is provided in which the therapist may add patients, modify records, archive data, delete patient files, etc.

As can be seen from above, the rehabilitation apparatus may be set up to automatically lead a patient through a set of exercise routines. As a result, the therapist is freed from necessity to directly interact with the patient during these routines. This frees the therapist to provide other services. Additionally, the apparatus can be utilized so that each of a number of patients are led through individualized routines at the same time thereby increasing the efficiency of the therapist. Finally, specific data can be generated for evaluating the performance of the patients so that exact range of movement and physical disability may be determined and subsequent progress of the patient monitored.

While the preferred embodiment of the invention has been described, it should be apparent to one having ordinary skill in the art that many modifications or changes may be made in the preferred embodiment without departing from the spirit of the present invention as expressed by the scope of the appended claims.

What I claim is:

1. An apparatus for the rehabilitation of patients comprising:

at least one patient station comprising:

means for selectively soliciting a contact from said patient, said means for soliciting being a light;

means for receiving said contact from said patient and generating a signal;

means for selectively moving said means for receiving to a predetermined position; said means for selectively moving having a robotic arm operable to selectively position said means for receiving to a predetermined position within a predetermined three dimensional area; and a central processing unit communicating with said at least one patient station, said central processing unit having means for receiving said signal from said means for receiving.

2. The rehabilitation apparatus of claim 1 wherein said means for receiving comprises a contact switch.

3. The rehabilitation apparatus of claim 1 wherein said patient station comprises a home switch which is connected to said central processing unit, said home switch movable for positioning adjacent to said patient.

4. A rehabilitation system for a patient said system comprising:

a central CPU for controlling the operation of said system;

at least one robotic arm having an end effector, said end effector having means for soliciting contact from said patient and means for receiving contact from said patient, said robotic arm selectively operable to position said end effector in at least one predetermined position within a predetermined three dimensional area, said end effector having a remote CPU and means for interconnecting said remote CPU with said means for soliciting and said means for receiving, said remote CPU controlling the operation of said means for soliciting and said means for receiving said remote CPU producing a signal when said means for receiving is contacted by said patient;

means for controlling the position of said robotic arm, in response to a command from said central CPU; and means for delivering said signal to said central CPU from said remote CPU; and means for receiving and storing said first and second signals whereby said signals may be accessed for analysis.

5. The system of claim 11 wherein said home switch has a light operable in response to a signal from said central CPU.

6. The system of claim 4 wherein said means for soliciting further comprises at least one light selectively operable in response to a signal from said remote CPU.

7. The system of claim 4 wherein said robotic arm further comprises means for determining the position of said end effector and communicating the position to said central CFU.

8. The system of claim 4 wherein said means for receiving and storing comprise a control board having at least one PROM mounted in said central CPU.

9. The system of claim 4 wherein said at least one robotic arm comprises a plurality of robotic arms.

10. A method of rehabilitation and testing of disabled patients, said method comprising:

tapping a home switch to generate a first signal in response to said contact;

receiving said first signal in a control board of a CPU;

storing said first signal;

moving a gripper switch to a predetermined position within a three dimensional area with a robotic arm in response to said first signal;

contacting said gripper switch then said gripper switch is in said predetermined position to generate a second signal;

receiving said second signal in a control board of a CPU;

measuring a time difference between said first signal and said second signal; and storing said time difference in said CPU.

11. A method of rehabilitation and testing of disabled patients, said method comprising:

positioning a response device at a predetermined position within a predetermined three dimensional area with a robotic arm;

soliciting a response from the patient;

waiting a period of time for the response;

receiving and storing a signal indicating a proper response;

recording the non-occurrence of a response signal in the event that a signal is not produced; and analyzing the performance of the patient.

12. The system of claim 4, further comprising a home switch and means for connecting said home switch with said central CPU, said home switch generating a signal when contacted by said patient.

* * * * *